US010619372B2

(12) United States Patent
Albaugh, II

(10) Patent No.: US 10,619,372 B2
(45) Date of Patent: Apr. 14, 2020

(54) KIT AND METHOD FOR PREVENTING A SWIMMING POOL CLEANER FROM BECOMING CAUGHT ON A MAIN DRAIN COVER

(76) Inventor: Harry Albaugh, II, Camarillo, CA (US)

( * ) Notice: Subject to any disclaimer, the term of this patent is extended or adjusted under 35 U.S.C. 154(b) by 993 days.

(21) Appl. No.: 13/052,109

(22) Filed: Mar. 21, 2011

(65) Prior Publication Data

US 2011/0225718 A1 Sep. 22, 2011

Related U.S. Application Data

(60) Provisional application No. 61/316,194, filed on Mar. 22, 2010.

(51) Int. Cl.
*E04H 4/16* (2006.01)

(52) U.S. Cl.
CPC ..... *E04H 4/1663* (2013.01); *Y10T 29/49826* (2015.01)

(58) Field of Classification Search
USPC ..... 4/496, 504; 29/428; 210/162, 163, 210/167.1, 167.16, 167.17; 81/176.15, 81/176.2, 177.2, 177.7, 177.8, 180.1, 488
See application file for complete search history.

(56) References Cited

U.S. PATENT DOCUMENTS

| | | | | |
|---|---|---|---|---|
| 2,086,722 | A * | 7/1937 | Matuella | 81/119 |
| 3,667,611 | A * | 6/1972 | Pansini | 210/244 |
| 4,170,047 | A | 10/1979 | Corsette et al. | |
| 4,658,449 | A | 4/1987 | Martin | |
| 5,926,865 | A * | 7/1999 | Witinski et al. | 4/496 |
| 6,397,408 | B1 | 6/2002 | Veloskey et al. | |
| 6,442,774 | B2 | 9/2002 | Wilson et al. | |
| 6,453,482 | B1 | 9/2002 | Mullings | |
| 6,588,029 | B2 | 7/2003 | Mullings | |
| 7,178,179 | B2 | 2/2007 | Barnes | |
| 2005/0022631 | A1 * | 2/2005 | Brazil | 81/119 |
| 2007/0061957 | A1 | 3/2007 | Meincke | |
| 2008/0141481 | A1 * | 6/2008 | Arvinte et al. | 15/236.01 |
| 2009/0019633 | A1 | 1/2009 | Snow et al. | |

* cited by examiner

*Primary Examiner* — Lauren A Crane
(74) *Attorney, Agent, or Firm* — Michael D. Eisenberg

(57) ABSTRACT

A kit for preventing a swimming pool cleaner from becoming caught on a main drain cover of a swimming pool including a flexible clip-on protective device with a printed company logo and an installation tool with three cylindrical retainers. The installation tool mounts the clip-on protective device onto the main drain cover to force the swimming pool cleaner to tilt to one side, so that the suction forces of the swimming pool cleaner and the main drain will not interact with each other. The installation tool is made by injection molding with a uniform thickness of 0.165 inch.

18 Claims, 10 Drawing Sheets

KIT AND METHOD FOR PREVENTING A SWIMMING POOL CLEANER FROM BECOMING CAUGHT ON A MAIN DRAIN COVER

CROSS-REFERENCE TO RELATED APPLICATION

This application claims the benefit of Provisional Patent Application No. 61/316,194, filed on Mar. 22, 2010, in the United States Patent & Trademark Office, the disclosure of which is incorporated herein by reference.

BACKGROUND OF THE INVENTION

Field of the Invention

The present invention relates to a system to prevent a pool cleaner from getting stuck on a pool main drain, and more particularly, a kit and method for preventing a swimming pool cleaner from becoming caught on a main drain cover.

The kit is designed to prevent commonly used, residential, automatic pool cleaners from becoming caught on the main drain cover. The kit provides an inexpensive and easy way to install a clip-on protective device onto the existing main drain cover of a swimming pool without an installer getting into the water. The clip-on protective device fits common types of main drain covers that are used in residential swimming pools.

Description of the Prior Art

It is very common for an automatic pool cleaner in a residential swimming pool to assume a stationary position immediately over the main drain cover. The pool cleaner will remain in the hung up position until it is manually repositioned. This can be inconvenient and time consuming. Changing the main drain flow rate and/or varying the pool cleaner's suction force does not prevent the pool cleaner from getting caught on the main drain cover. A more efficient method is needed.

Numerous innovations for pool drain guards have been provided in the prior art that will be described. Even though these innovations may be suitable for the specific individual purposes to which they address, however, they differ from the present invention.

A FIRST EXAMPLE, U.S. Pat. No. 4,170,047, Issued on Oct. 9, 1979, to Corsette, et al. teaches a protective cover for swimming pools drains and the like. The cover is of a unitary construction and is preferably injection-molded from a flexible, tough, spring-like plastic. The cover includes an outer, annular rim designed to rest on a sub-main drain or the like. The main cover has no holes and features a generally sine wave or bellows spring design. The central portion is inwardly or downwardly curved, and forms a portion of a sphere having its center on a line normal to a plane passing through the main cover. The central portion is surrounded by another inwardly curved portion which preferably is provided on its underside with a circular projection extending normal to the plane of the cover to lend it mechanical rigidity. The outer main cover portion is upwardly curved and is connected to the ring portion through a plurality of stanchions in the form of vanes extending in radial directions. Due to its spring-like construction, the cover will spring back under loads within elastic limits of the material and even limited overloads causing a permanent set will not cause the cover to lose its full function.

A SECOND EXAMPLE, U.S. Pat. No. 4,658,449, Issued on Apr. 21, 1987, to Martin teaches an adapter for pool drains, including a primary mounting frame secured onto the pool drain with a plurality of arms radiating inwardly and raised to interconnect the second mounting ring. There is further provided a grill work or second secured to the surface of the apparatus for defining a raised screening surface for screening any water flowing into the drain to prevent whirlpooling effect in the drain. Further, the apparatus is adapted for various size drains and is easily removable and set in place.

A THIRD EXAMPLE, U.S. Pat. No. 6,397,408, Issued on Jun. 4, 2002, to Veloskey teaches a ramped cap unit for installation into a swimming pool in a position covering a main pool drain equipped with an upstanding antivortex safety drain cover plate, wherein the ramped cap unit has a smoothly contoured shape to permit a pool cleaner device to travel thereover without interrupting or obstructing cleaning operation. The cap unit comprises a generally inverted saucer defining a smoothly sloping and convex or ramped upwardly presented surface having a diametric size and shape to fit over the safety drain cover plate. An array of ribs formed on the underside of the cap unit engage an outer periphery of the upstanding cover plate to retain the cap unit in position thereon. A large plurality of vents are formed in the cap unit at spaced-apart locations to permit downward water flow therethrough substantially without disrupting the antivortex and safety functions of the underlying drain cover plate. The ramped upper surface of the cap unit permits a pool cleaner device to climb directly over the cap unit in the course of pool cleaner travel over submerged pool surfaces to collect and dislodge particulate debris settled thereon.

A FOURTH EXAMPLE, U.S. Pat. No. 6,442,774, Issued on Sep. 3, 2002, to Wilson et al. teaches a cover for an end of a conduit. The cover comprises a front face covering the conduit end and a back face having fasteners for attachment to a conduit. A plurality of apertures passes between the front face and back face to allow the flow of liquid to and/or from the conduit. The edges of the front face defining the entrances to the apertures are non-planar. In addition to, or as an alternative to, the apertures are formed such that the flow of liquid between the front and back faces is deflected so that the liquid follows at least two directions in passing between the front and back faces. The cover can be used as a grille over drainage in a swimming pool.

A FIFTH EXAMPLE, U.S. Pat. No. 6,453,482, Issued on Sep. 24, 2002, to Mullings teaches a safety cover for swimming pool drains for dispersing suction pressure and preventing a person's hair or other body parts from becoming entangled and otherwise preventing injury or death. A generally dome-shaped drain cover is removably affixed to a new and/or existing suction drain using a universal mounting mechanism. The drain cover is preferably circular and includes a peripheral lip, a sidewall, and a segmented dome-shaped top portion. The peripheral lip functions to form a seal with the bottom surface of the pool surrounding the drain, while the sidewall defines a plurality of openings therein and the segmented dome-shaped top portion defines a plurality of segments each of which include a plurality of openings. Each opening incorporates screen mesh material for allowing water to flow therethrough. A universal mounting mechanism comprising a rigid bar member adapted for attachment to an existing drain and a generally cylindrical structure adapted for connecting the drain cover to the rigid bar member.

A SIXTH EXAMPLE, U.S. Pat. No. 6,588,029, Issued on Jul. 8, 2003, to Mullings teaches a safety cover for swimming pool drains for dispersing suction pressure and preventing a person's hair or other body parts from becoming entangled and otherwise preventing injury or death. A generally dome-shaped drain cover is removably affixed to a new and/or existing suction drain using a universal mounting mechanism. The drain cover is preferably circular and includes a peripheral lip, a sidewall, and a segmented dome-shaped top portion. The peripheral lip functions to form a seal with the bottom surface of the pool surrounding the drain, while the sidewall defines a plurality of openings therein and the segmented dome-shaped top portion defines a plurality of segments each of which include a plurality of openings. Each opening incorporates screen mesh material for allowing water to flow therethrough.

A SEVENTH EXAMPLE, U.S. Pat. No. 7,178,179, Issued on Feb. 20, 2007, to Barnes teaches a drain for swimming pools, spas, whirlpool baths, etc., includes a plurality of first orifices in communication with corresponding serpentine passageways to minimize hair or a body part from covering and entering the first orifices to a degree sufficient to entrap a bather. A plurality of second orifices independent of the first orifices and in fluid communication with one another through a peripheral passageway provide a flow of water from the peripheral passageway into the serpentine passageways to create an alternate water inflow path and reduce the pressure differential and possible entrapment that might occur should a body part or hair come in contact with or enter the first orifices. Moreover, a plurality of ridges are attendant the first orifices to reduce the likelihood of direct contact with the first orifices by a body part or hair.

AN EIGHTH EXAMPLE, U.S. Patent Office Publication No. 2007/0061957, Published on Mar. 22, 2007, to Meincke teaches a main drain of a swimming pool has a housing, a removable cover, and one elongated opening formed therein. In one embodiment, the housing is oval in shape with the elongated opening running parallel to the major dimension of the housing to provide a single extended opening that would be difficult for a swimmer to obstruct. In an alternative embodiment, the elongated opening extends over a round cover and is H-shaped. Each elongated opening is formed to have an internally curved flange to provide a smooth edge and structural stiffness for the cover. The single extended opening with its smooth, rounded edges reduces the likelihood of entrapment and entanglement and allows large debris, such as leaves, to pass more easily into the main drain.

A NINTH EXAMPLE, U.S. Patent Office Publication No. 2009/0019633, Published on Jan. 22, 2009, to Snow et al. teaches an apparatus and system for a pool drain cover, the cover having a perforated ramp around its perimeter to which are attached a plurality of straight, horizontally disposed tubes, circumscribing channels with substantially continuous cross-sectional areas, each tube enclosing a channel extending the length of the tube of at least six inches. The cross-sectional area of the tubes is kept at a minimum and their number is increased by arranging the tubes in rows and columns or giving the tubes an elliptical cross-sectional area and arranging them in a single row, thereby reducing the tapering in the tubes. The cover may be segmented and may be of multiple shapes, including a circle.

It is apparent now that numerous innovations for pool drain guards have been provided in the prior art that are adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a kit for preventing a swimming pool cleaner from becoming caught on a main drain cover of a swimming pool that avoids the disadvantages of the prior art.

ANOTHER OBJECT of the present invention is to provide a kit for preventing a swimming pool cleaner from becoming caught on a main drain cover of a swimming pool that is simple and inexpensive to manufacture.

STILL ANOTHER OBJECT of the present invention is to provide a kit for preventing a swimming pool cleaner from becoming caught on a main drain cover of a swimming pool that is simple to use.

BRIEFLY STATED, STILL YET ANOTHER OBJECT of the present invention is to provide a kit for preventing a swimming pool cleaner from becoming caught on a main drain cover of a swimming pool comprising a clip-on protective device. An installation tool mounts the clip-on protective device onto the main drain cover to force the swimming pool cleaner to tilt to one side, so that the suction forces of the swimming pool cleaner and the main drain will not interact with each other.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows.

REFERENCE NUMERALS UTILIZED IN THE DRAWING

110 kit

112 swimming pool cleaner

Figure 1B:
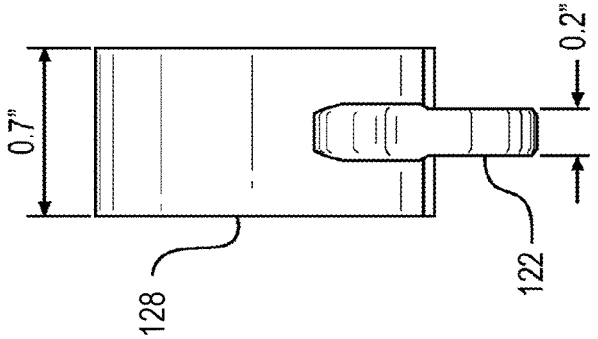
FIG. 1B is a cross-sectional view of the clip-on protective device.

114 main drain cover
116 swimming pool
118 clip-on protective device of kit 110
119 installation tool
120 arch shaped flexible member of device 118
122 mounting hook of member 120
124 apertures of a circular ring of plurality of apertures in main drain cover 114
126 durable UV resistant plastic material of member 120
128 shaft of tool 119
130 pool utility pole
132 flat extension piece of shaft 128
134 threaded shank of tool 119
136 triangular shaped head of tool 119
138 wing nut of tool 119 to tie up with a shaft 128
140 (A,B,C) cylindrical retainers of tool 119 arranged in a triangular configuration
148 hexagonal ridges to hold the nut of the wing nut 138

DETAILED DESCRIPTION OF THE PREFERRED EMBODIMENT

Figure 1A:
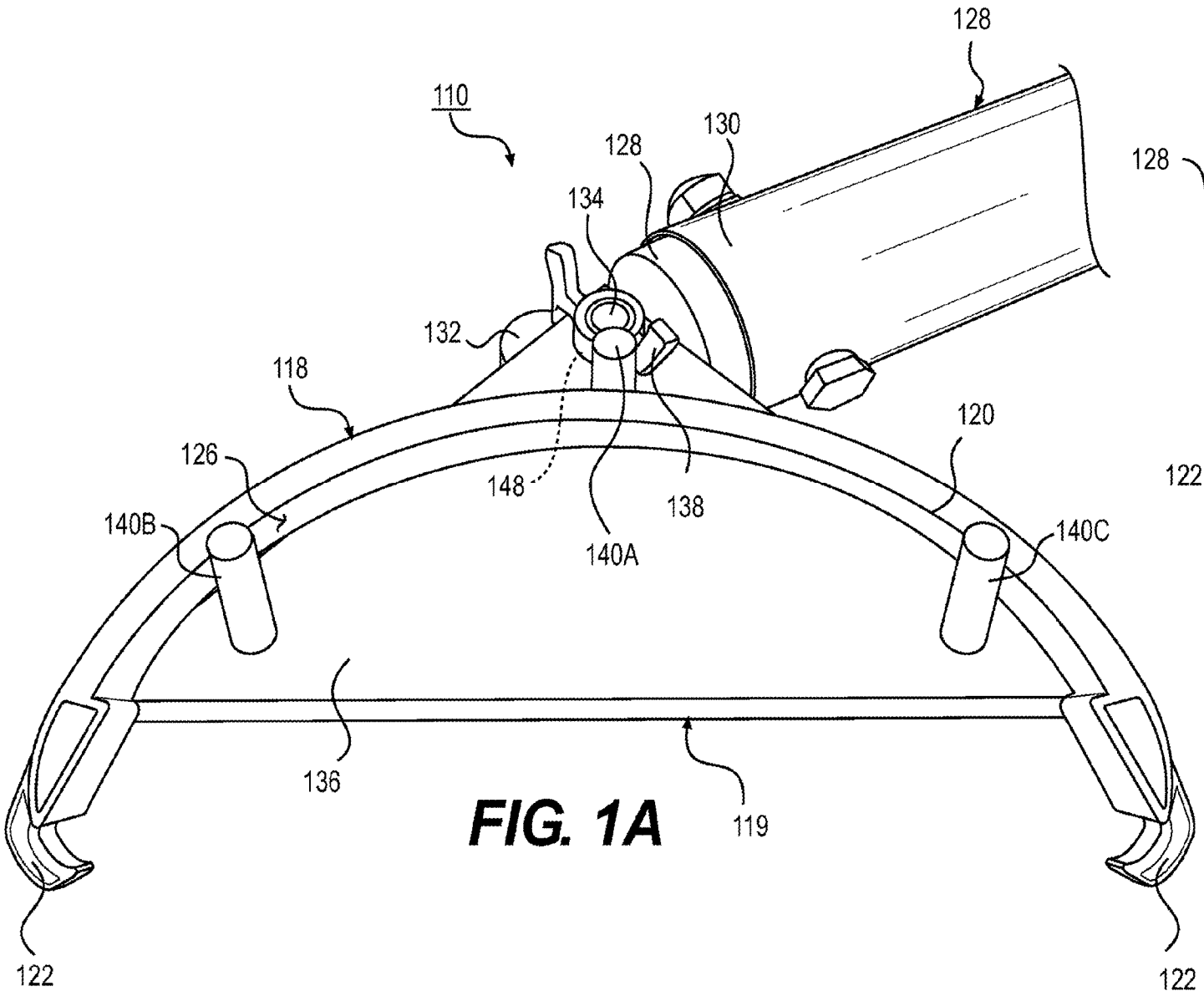
FIG. 1A is a perspective view of the present invention.
Figure 6:
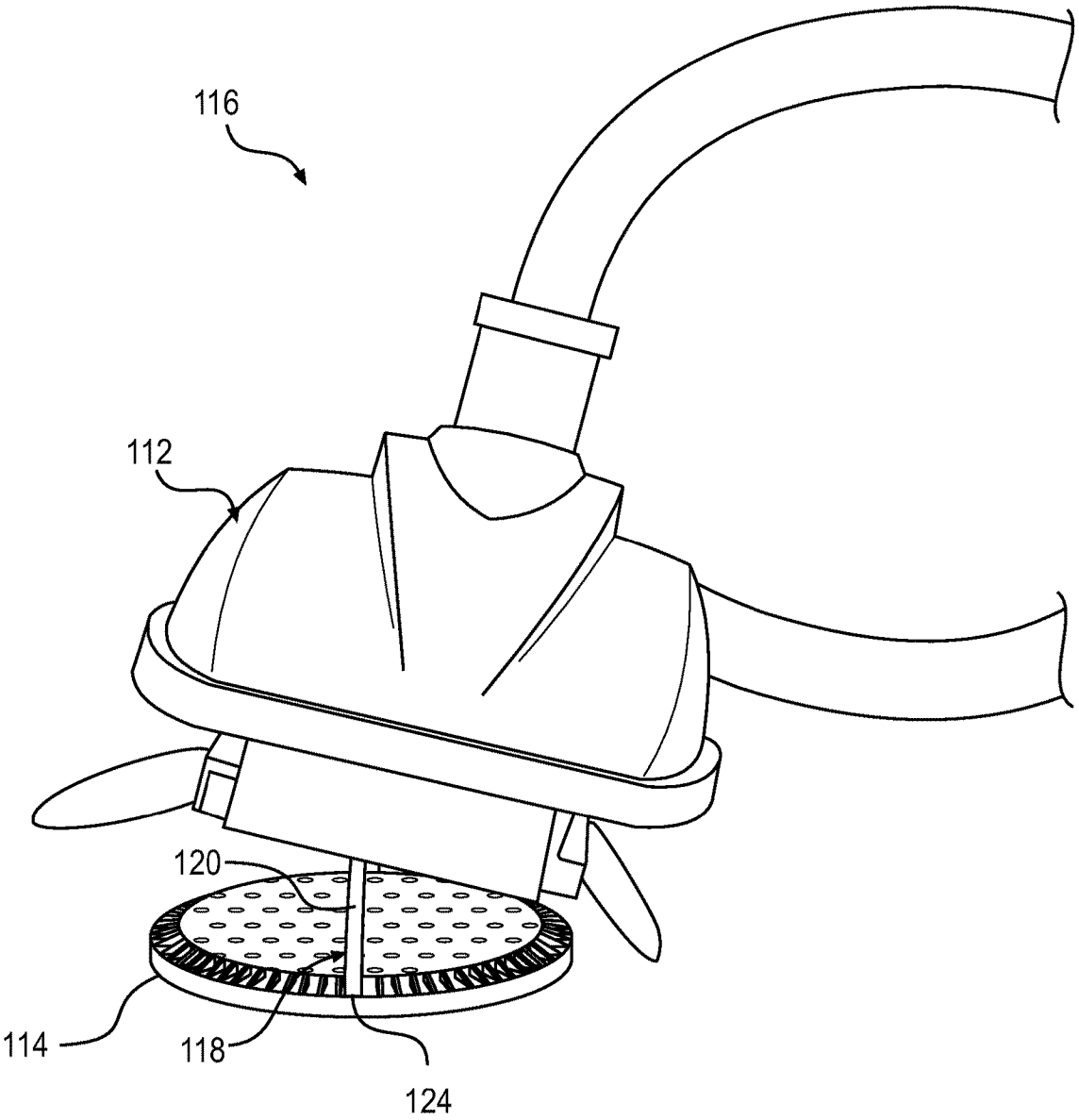
FIG. 6 is a perspective view showing the clip-on protective device preventing the pool cleaner from getting caught on the main drain cover of the swimming pool.

As shown in FIG. 1A, the present invention is a kit 110 for preventing a swimming pool cleaner 112 (as shown in FIG. 6) from becoming caught on a main drain cover 114 of a swimming pool 116. The kit 110 includes a clip-on protective device 118 and an installation tool 119. An installation tool 119 mounts the clip-on protective device 118 onto the main drain cover 114 to force the swimming pool cleaner 112 to tilt to one side, so that the suction forces of the swimming pool cleaner 112 and the main drain will not interact with each other. A threaded shank 134 is mounted transversely to the flat extension piece 132. A triangular shaped head 136 has a hole (not shown) at an apex thereof for the threaded shank 134 to extend therethrough. Awing nut 138 engages with the threaded shank 134 to pivotally retain the triangular shaped head 136 to the flat extension piece 132. Three spaced apart cylindrical retainers 140A, 140B, 140C are on the triangular shaped head 136 to releasably hold the clip-on protective device 118 thereto. The three cylindrical retainers 140A, 140B, 140C are arranged in a triangular configuration. The distance between apex retainer 140A to each other retainer 140B or 140C is about 2.0 inches. The distance between two retainers 140A and 140B is about 3.5 inches. Each of the retainers 140A-140C has a height of 0.85 inch and a radius of 0.15 inch.

FIG. 1B, shows a cross-sectional view of the clip-on protective device 118. The clip-on protective device 118 and resting portions have a thickness of 0.7 inch. Each of two mounting hooks (on both sides of the clip-on protective device 118) has a thickness or a width of 0.2 inch and a length of 0.3 inch.

Figure 1C:
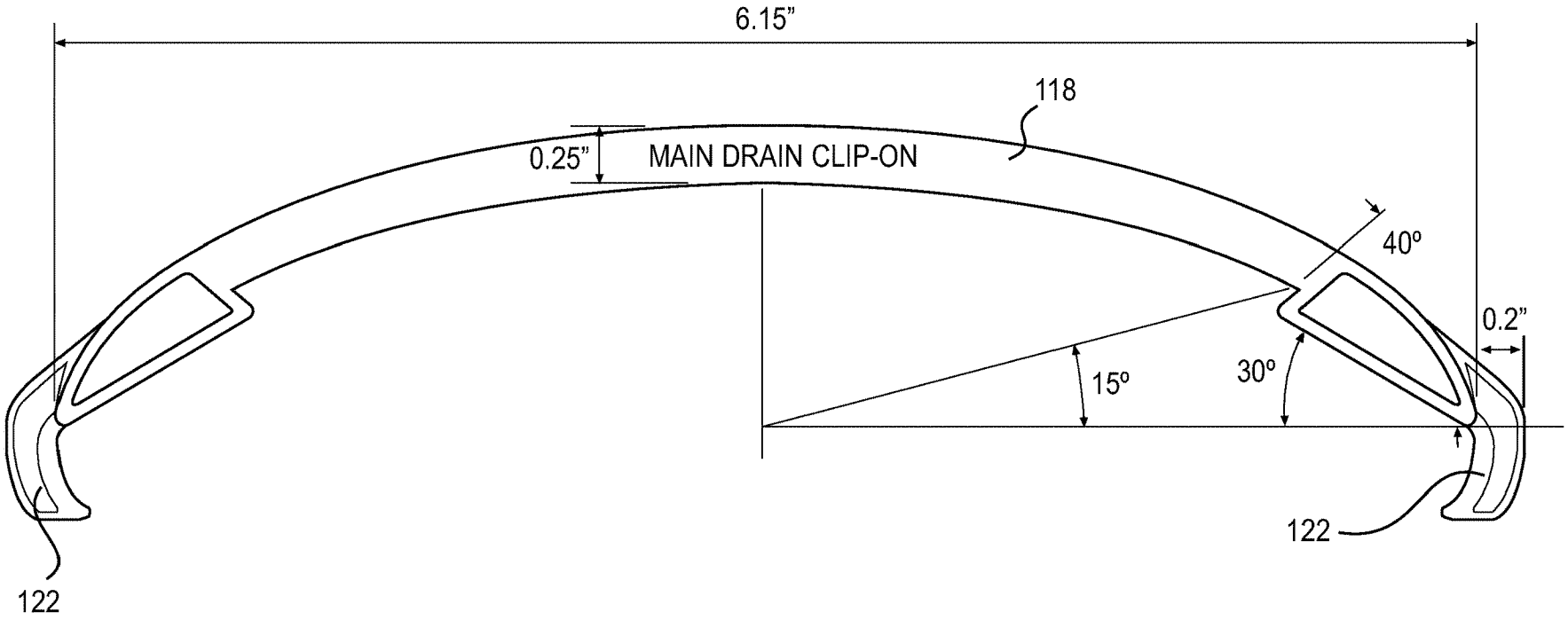
FIG. 1C is a front-view of the clip-on protective device.

In FIGS. 1A & 1C: the clip-on protective device 118 comprises an arch shaped flexible member 120 having two resting portions and two mounting hooks 122 each located on each end thereof to engage with two opposite apertures 124 of a circular ring of the apertures of the main drain cover 114. The width of the apertures 124 is about 0.3 inch. The circular ring includes about 50 apertures. In FIG. 1C, each of the resting portion formed an angle 30° degrees to the horizontal line. The two resting portions flatly engage a top surface of the main drain cover 114 and help to hold strongly the clip-on protective device 118 in a vertical position. The width of the resting portions is the same as the width 0.7 inch of the arch shaped flexible member 120 and the length is 0.8 inch.

The arch shaped flexible member 120 is comprised out of a durable UV resistant plastic material 126. The durable UV resistant plastic material 126 can be resistant to sunlight's degradation and be transparent or is available in a variety of colors to match with the interior of the swimming pool 116. The UV resistant plastic material 126 has a specific gravity less than 1.0 so the clip-on protective device 118 floats and therefore can be easily retrieved from the pool. A company logo "Main Drain Clip-On" or a company website www-.mandrainclipon.com can be imprinted on the device 118.

In FIG. 1C: the clip-on protective device 118 is approximately ½ (0.5) inch to two (02) inches in height, five inches to seven inches wide, and up to on inch deep. The optimal wide of the arch is 6.15 inches. The height of the device 118 is 0.25 inch. The durable UV resistant plastic material 126 of member 120 is made of Polypropylene (PP). The installation tool 119 and shaft 128 of tool 119 are both made of Polyamide (PA), and Glass fiber Reinforcement 10%.

Figure 3:
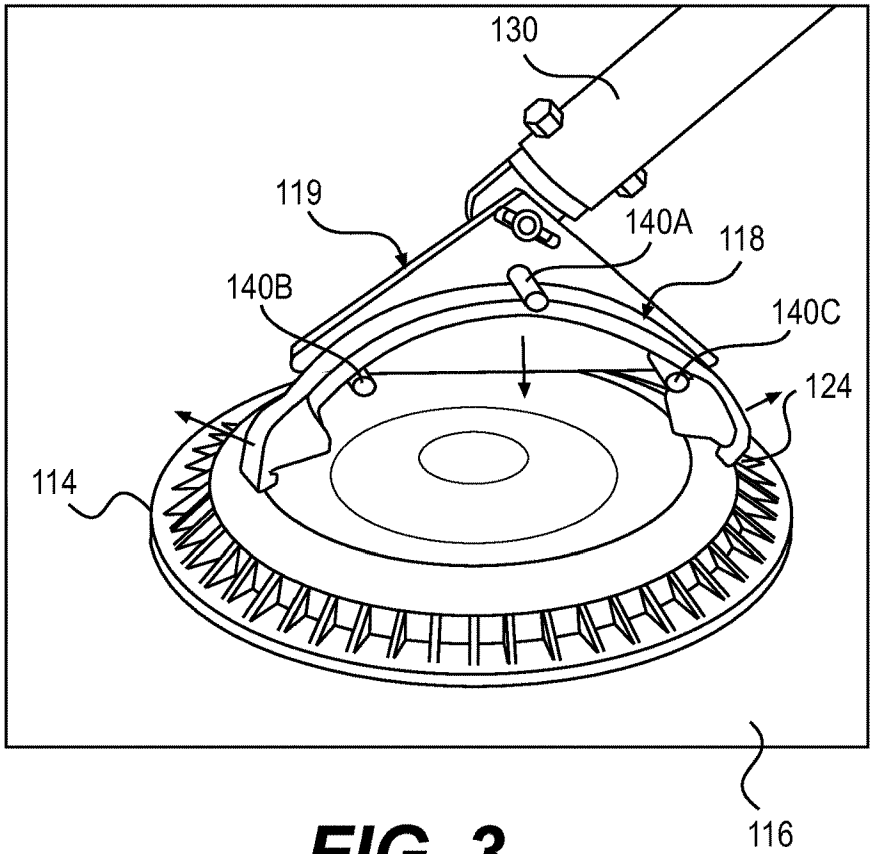
FIG. 3 is a perspective view showing one end of the clip-on protective device inserted into first aperture of a circular ring of plurality of apertures in the main drain cover.
Figure 2:
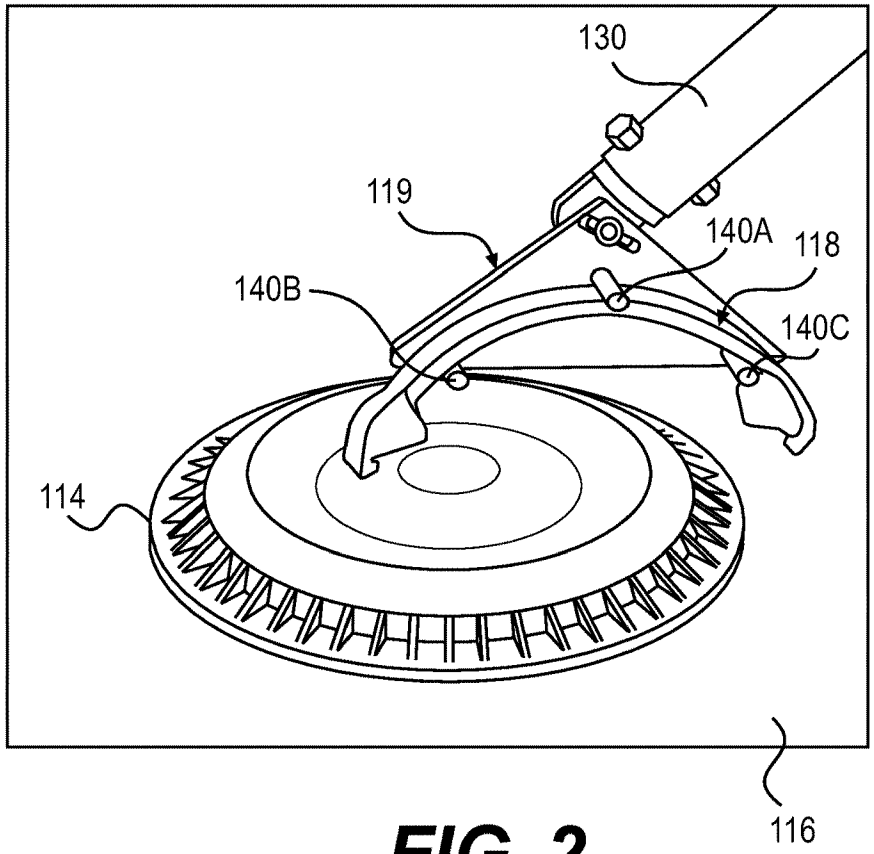
FIG. 2 is a perspective view showing the clip-on protective device on the installation tool ready to be installed on the main drain cover.
Figure 5:
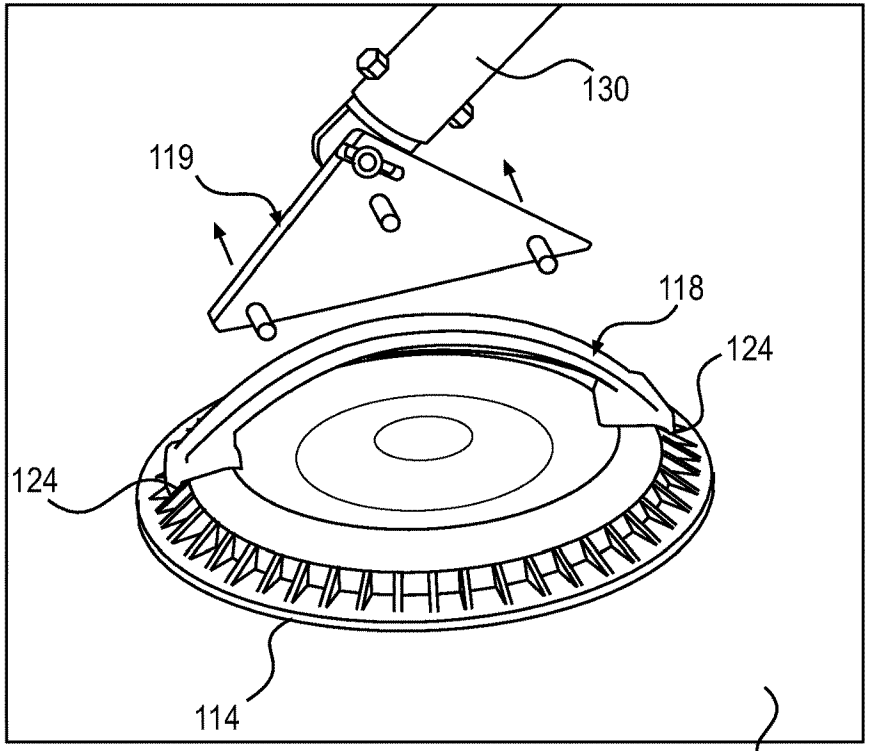
FIG. 5 is a perspective view showing the installation tool removed from the clip-on protective device on the main drain cover.
Figure 4:
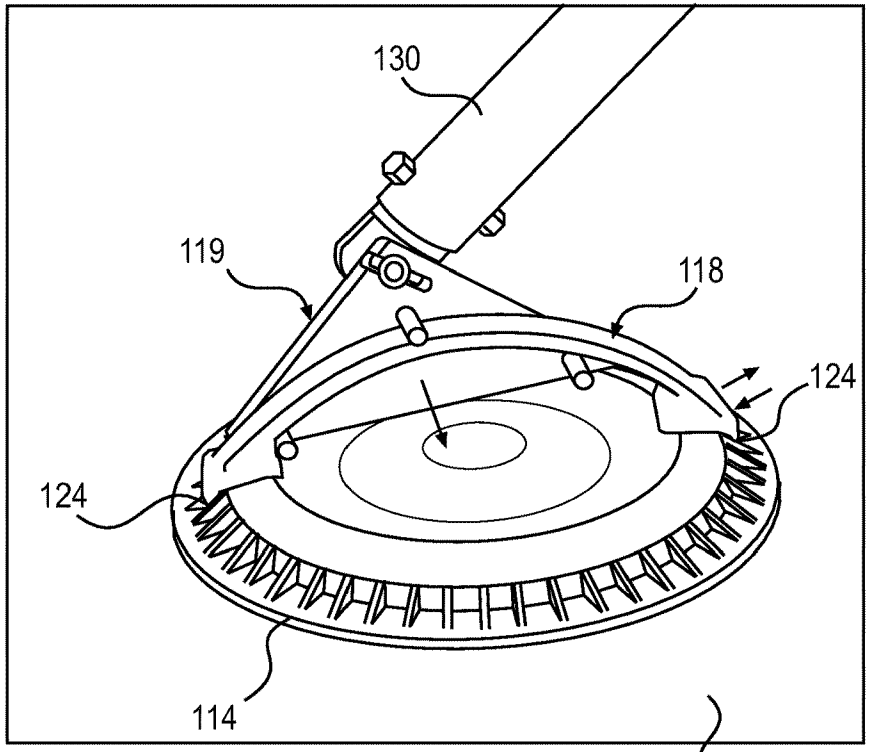
FIG. 4 is a perspective view showing another end of the clip-on protective device inserted into a second aperture of a circular ring of plurality of apertures in the main drain cover.

In FIGS. 2-6: A method for preventing the swimming pool cleaner 112 from becoming caught on the main drain cover 114 of the swimming pool 116 comprises the steps of:

1. Attach the installation tool 119 to the telescoping pool utility pole 130.
2. Place the clip-on protective device 118 onto the installation tool 119. Then, the installation tool 119 firmly holds the clip-on protective device 118 in place during the installation process.
3. Maneuver the installation tool 119 with the clip-on protective device 118 in an upstanding or vertical position over the main drain cover 114 from one side of the swimming pool 116, as shown in FIG. 2.
4. Insert a first end of the clip-on protective device 118 into a first aperture 124 on an outer circumference of the main drain cover 114, as shown in FIG. 3.
5. Stretch the clip-on protective device 118 across the main drain cover 114.
6. Snap a second end of the clip-on protective device 118 into another or second aperture 124 on the outer circumference of the main drain cover 114, as shown in FIG. 4. After the clip-on protective device 118 has been stretched into place across the main drain cover 114, the arch of the clip-on device 118 has a larger radius (4.0 inch) than the arch (with 3.8 inch radius) defined by the three retainers (140A, 140B, 140C) of the installation tool 119.
7. Remove the installation tool 119 from the clip-on protective device 118, as shown in FIG. 5. After installation, the clip-on device 118 pinches the main drain cover 114. Once installed on the main drain cover 114 the clip-on protective device 118 no longer pushes upward on the center (apex) 140A retainer, nor pinches inward on the lower two 140B-C retainers, thereby releasing the installation tool 119 to be horizontally removed from the clip-on protective device 118 (see FIGS. 4 and 5).

In FIG. 6, the clip-on protective device 118 will prevent the swimming pool cleaner 112 from becoming caught on the main drain cover 114 of the swimming pool 116.

When installed, the shape of the clip-on protective device 118 forces the swimming pool cleaner 112 to tilt to one side regardless of direction of approach or speed and does not allow the suction forces of the swimming pool cleaner 112 and the main drain to interact to an extent that would cause the swimming pool cleaner 112 to hang-up over the main drain cover 114. The arch shaped flexible member 120 of the device 118 is made of the durable UV resistant plastic material 126. The plastic UV resistant material 126 can be transparent, or available in a variety of colors to match the interior of the swimming pool 116. The arch shaped flexible member 120 snaps onto the existing main drain cover 114. The installation tool 119 is also part of the present invention. The installation tool 119 is connected to the pool utility pole 130, allowing an individual to attach and remove the clip-on protective device 118 without getting in the water. Simply maneuver the device 118 in order to place amounting hook 122 into an aperture 124 in the main drain cover 114. Gently push on the utility pole 130 and place another mounting hook 122 into another aperture 124 in an opposite side of the main drain cover 114. Because the arch shaped flexible member 120 is stretched during the installation process, the arch shaped flexible member 120 will be held firmly to the main drain cover 114 and can be released from the installation tool 119. The arch shaped flexible member 120 fits onto any standard flat top or curved top main drain cover 114. Due to the shape of the installed clip-on protective device 118, the water flow into the main pool drain and the swimming pool cleaner 112 is not compromised.

First way: the installation tool 119 is attached to shaft 128 of tool 119 using threaded shank 134 of tool 119 and wing nut 138 of tool 119. The flat smooth surfaces of flat extension piece 132 of shaft 128 and 119 installation tool are facing each other. This allows the installer to adjust the "swivel resistance" between flat extension piece 132 and installation tool 119 by tightening or loosening wing nut 138. Having the ability to vary the "swivel resistance" is a benefit and makes some installations easier.

Second Way: The installation tool 119 has five (05) keyways 152 on the back or on the flat extension piece 132 of shaft 128. When the shaft 128 and tool 119 are assembled with the key 150 of 132 facing tool 119, the key 150 will fit into one of the available five (05) keyways 152 thus giving the installer the ability to select a fixed angular position of tool 119 with respect to shaft 128. The installer may change the angular relationship in increments of 22.5 degrees. Having the ability to choose different fixed positions is a benefit and makes some installations easier.

Figure 7A:
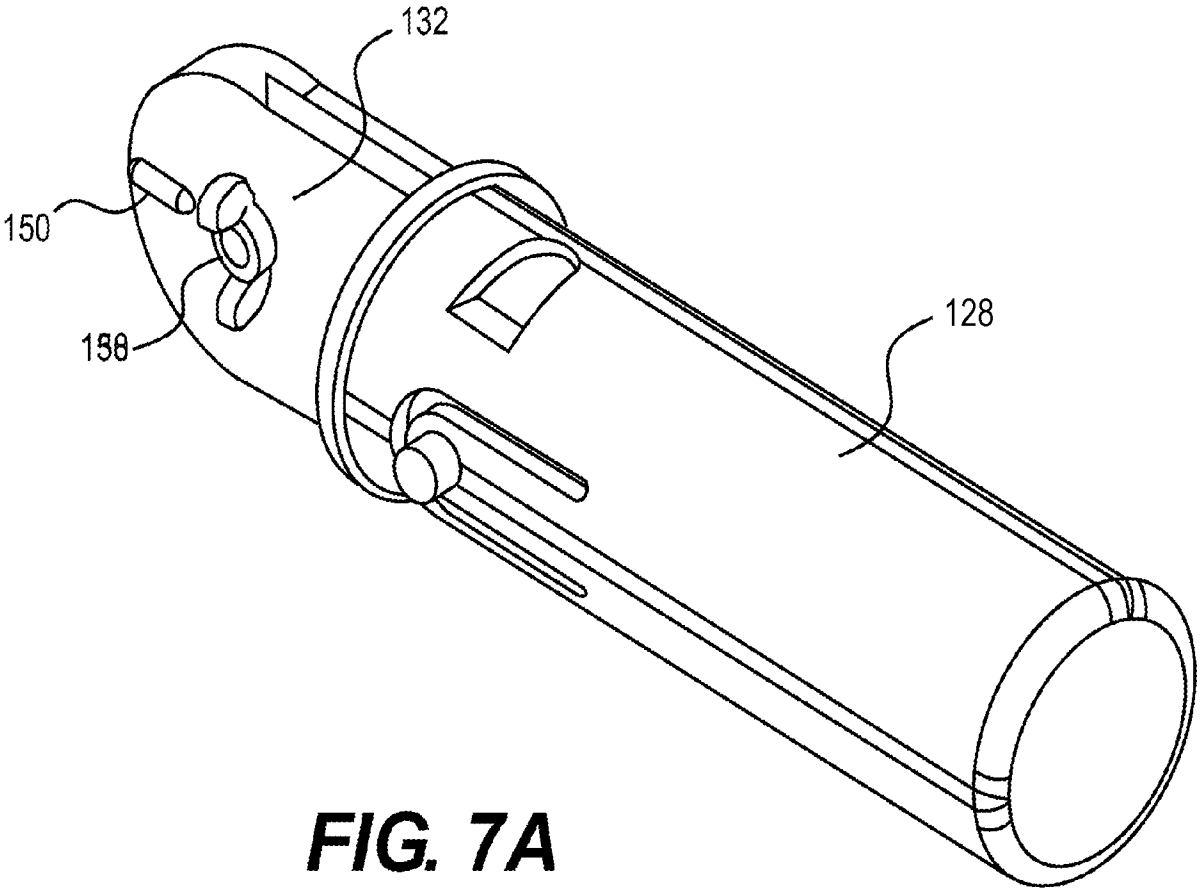
FIG. 7A is a perspective view of the shaft of the installation tool.
Figure 7B:
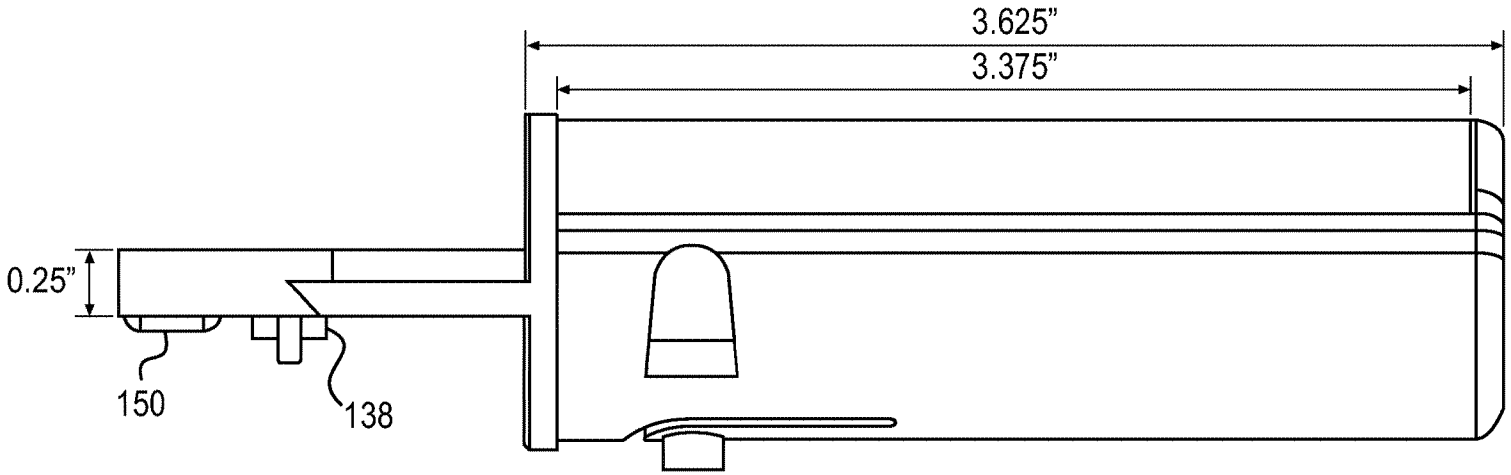
FIG. 7B is a top view of the shaft of the installation tool.
Figure 7C:
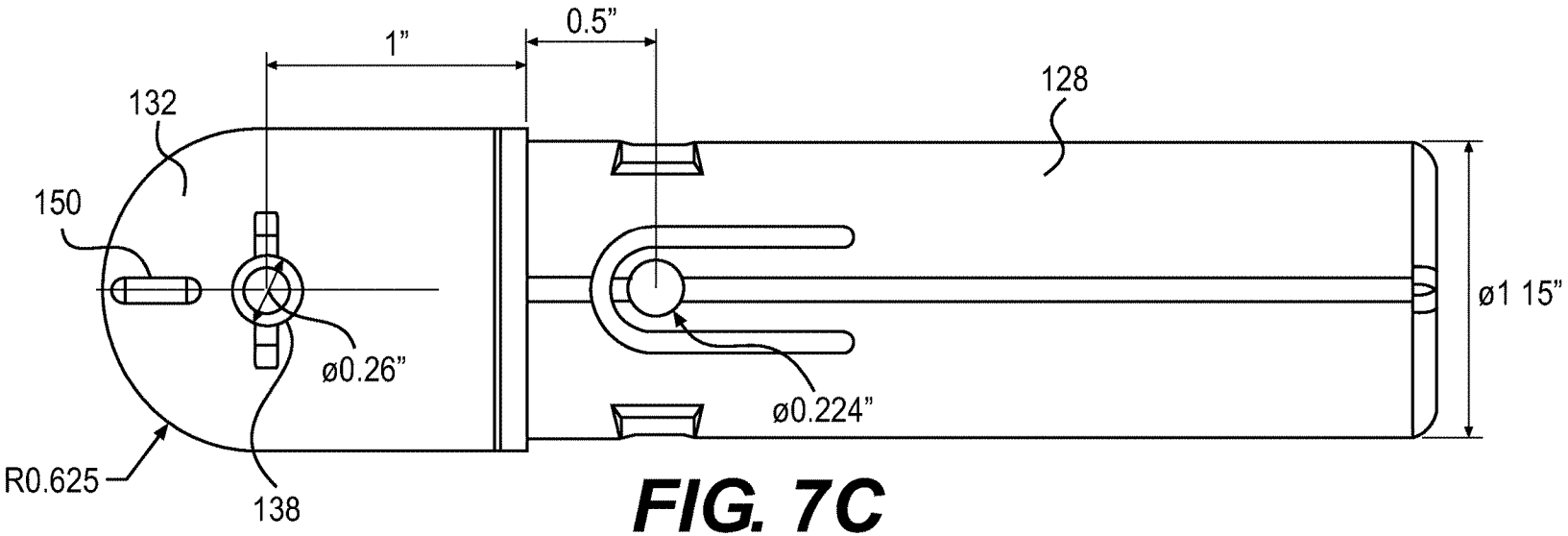
FIG. 7C is a front view of the shaft of the installation tool.

In FIGS. 7A-7C: the installation tool 119 comprises a shaft 128 insertable and maintained within an open end of a telescoping pool utility pole 130. The shaft 128 has a flat extension piece 132 thereon. The flat extension piece 132 has a thickness of 0.25 inch, a hole (diameter of 0.26 inch) for wing nut 138 and a key 150. The shaft 128 has a length of 3.625 inches.

Figure 8B:
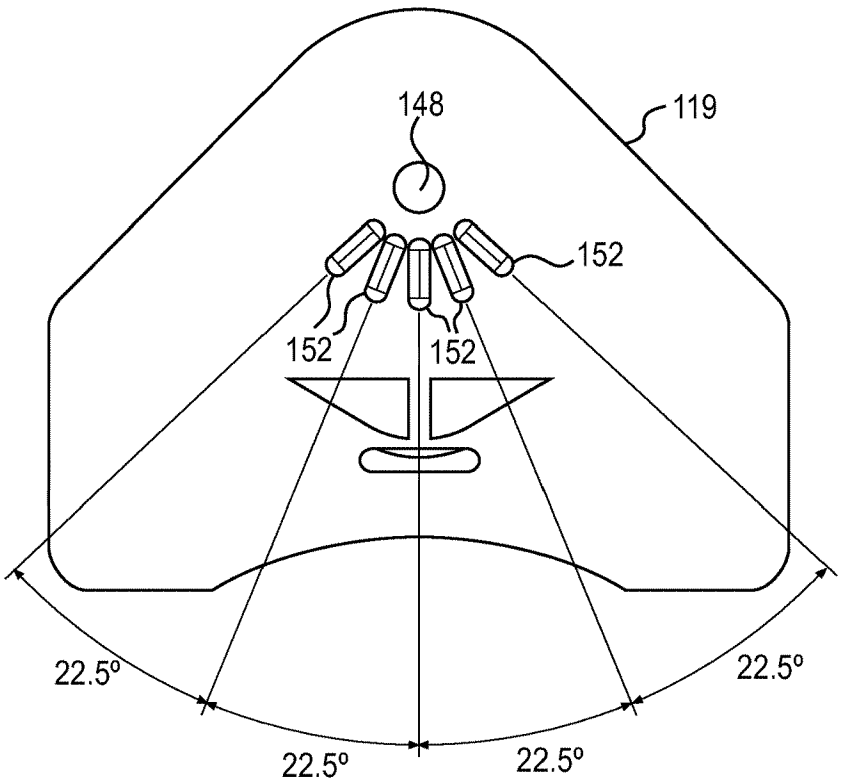
FIG. 8B is a back view of the installation tool.
Figure 8A:
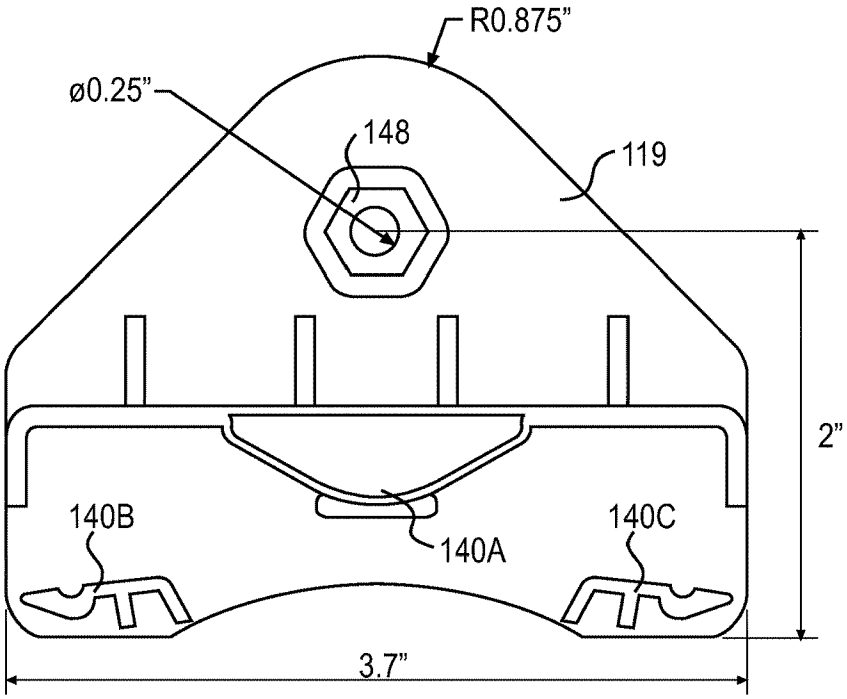
FIG. 8A is a front view of the installation tool.

FIG. 8A is a front view of the installation tool 119 with dimensions: length 3.7 inch; height 2.875 inches (2 inches+ 0.875 inch), with a hexagonal ridge 148 (height 0.33 inch) for holding nut of the wing nut.

FIG. 8B shows a back view of the installation tool 119 with five (05) keyways or keyslots 152 in incremental angle 22.5 degrees.

Figure 8D:
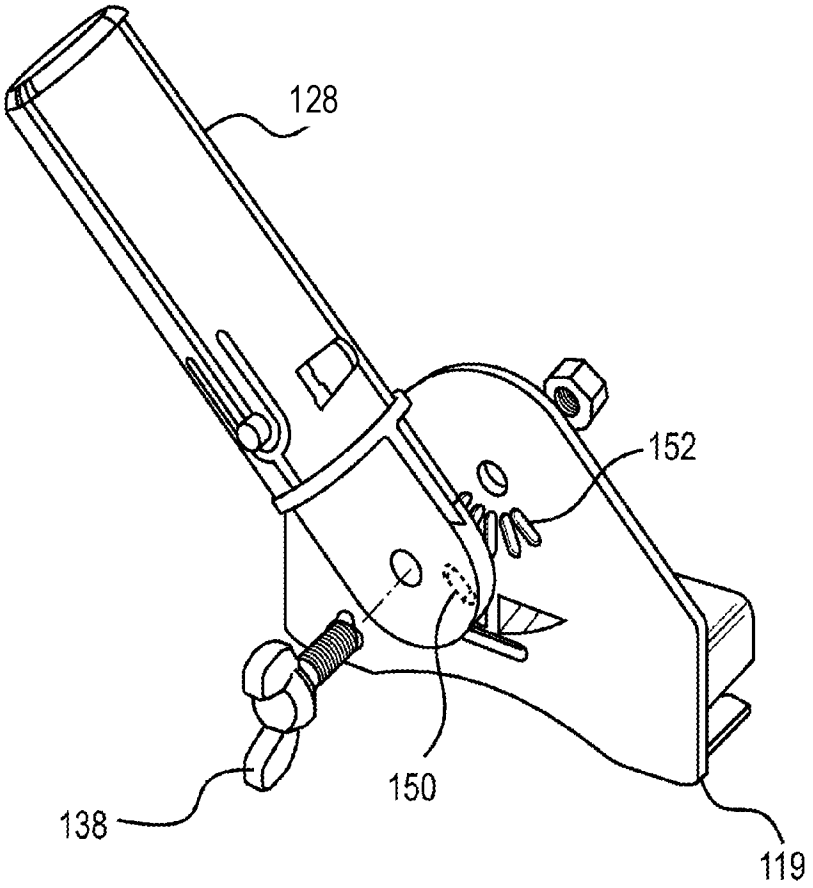
FIG. 8D is a back view of the installation tool with the shaft.
Figure 8C:
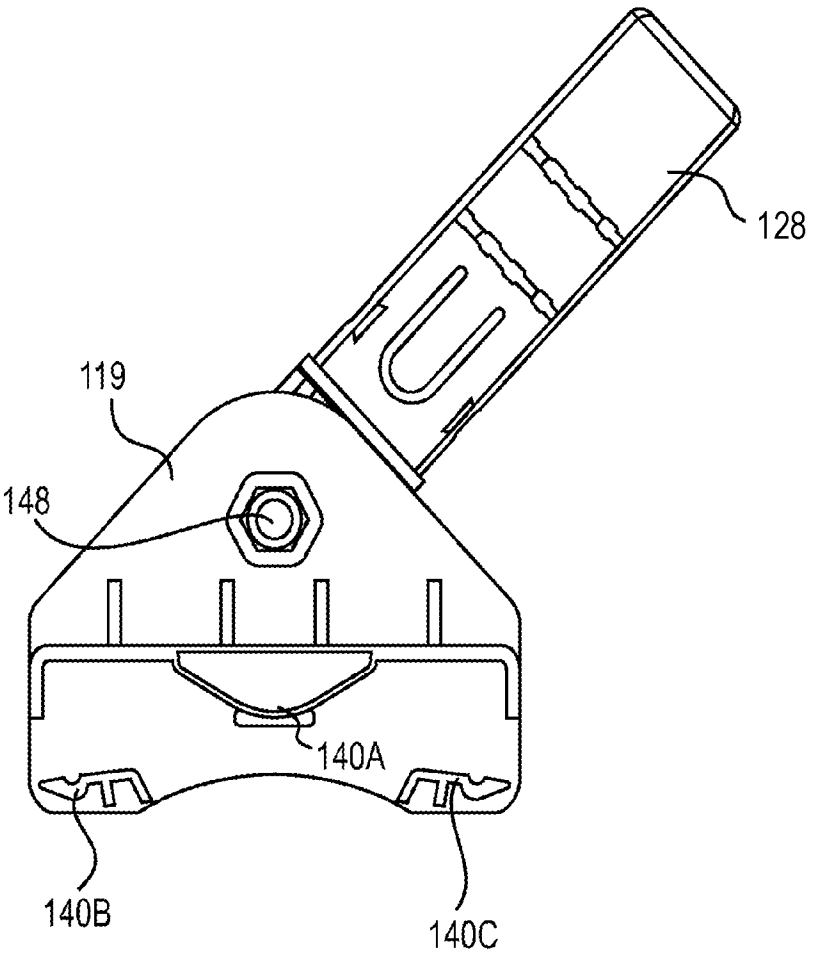
FIG. 8C is a front view of the installation tool with the shaft.

FIG. 8C shows a front view of the installation tool 119 with the shaft 118.

FIG. 8D shows a back view of the installation tool 119 with the shaft 118 in mating between key 150 and one of the keyway 152.

Figure 8E:
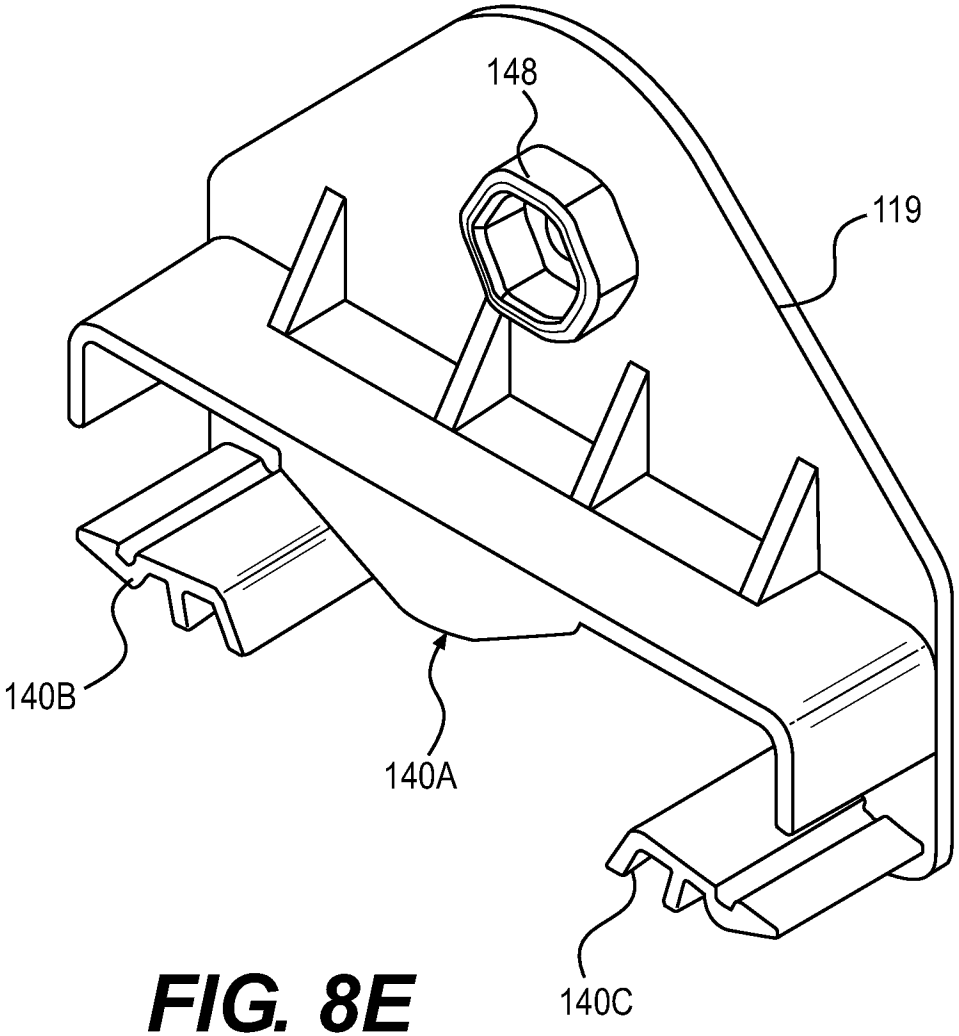
FIG. 8E is a perspective view of the installation tool.

FIG. 8E shows the installation tool 119 that has been optimized to facilitate the injection molding manufacturing process. The installation tool 119 has a uniform thickness of 0.165 inch. Injection molding is the most common method of part manufacturing, and is ideal for producing high volumes of the same object. The installation tool 119, as pictured in FIG. 8E, is optimized to take advantage of injection molding high production rates, repeatable high tolerances, minimal scrap losses, and lowest need to finish parts after molding. The installation tool 119 has been optimized for functionality, cosmetics, cost and the plastic injection molding manufacturing process. The installation tool 119 maintains a uniform wall thickness 0.165 inch throughout the part. Having a uniform wall thickness 0.165 inch throughout is essential to efficiently producing a molding (final part) with minimal warping and consistent dimensional tolerances using the injection molding process.

In FIG. 8E: the cylindrical shape of the retainers in installation tool 119 (pictured in FIGS. 1A, and 2-5) has been changed to specific shape in FIG. 8E.

All the characteristics of the retainers (pictured in FIGS. 1A, and 2-5) are maintained in the installation tool 119 (pictured in FIG. 8E). The only difference between the installation tool 119 (pictured in FIGS. 1A, and 2-5), and that in FIG. 8E is the shape has been optimized to facilitate the injection molding manufacturing process.

Specifically, the retainers 140B and 140C of tool 119 have been optimized to maintain a uniform wall thickness (0.165 inch) throughout the installation tool 119. The height of the retainers is 0.85 inch. The shapes of the retainers 140B and 140C of the installation tool 119 have been changed to resemble an elongated "wedge" shape with uniform wall thickness (0.165 inch). This "wedge shape" facilitates maintaining a uniform wall thickness throughout the part and increases the overall strength of the installation tool 119.

The shape of 140A retainer of tool 119 has been changed to resemble a "hollow triangle" with an "extended fence" on top (also see FIGS. 8A, 8B, 8C, 8D and 8E). This unique shape of retainer 140A of the installation tool 119 facilitates maintaining a uniform wall thickness throughout the part and increases the overall strength of the installation tool 119. The exact specifications may vary.

It will be understood that each of the elements described above, or two or more together, may also find a useful application in other types of constructions differing from the types described above.

While the invention has been illustrated and described as embodiments of a method for installing a clip-on protective device onto a main drain cover of a swimming pool, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A kit for preventing a swimming pool cleaner from becoming caught on a main drain cover being on top of a main drain of a swimming pool comprising:

a) a clip-on protective device; and b) an installation tool to mount the clip-on protective device onto two opposite apertures of a circular ring of apertures of the main drain cover at a bottom of a swimming pool to force the swimming pool cleaner to tilt to one side, so that suction forces of the swimming pool cleaner and the main drain will not interact with each other;

wherein the clip-on protective device comprises an arch shaped flexible member having two resting portions and two mounting hooks each located on each end thereof to engage with the two opposite apertures of the circular ring of apertures of the main drain cover.

2. The kit as recited in claim 1, wherein the arched shaped flexible member is comprised out of a durable UV resistant plastic material having a specific gravity less than 1.0 so the clip-on protective device floats and therefore can be easily retrieved from the pool.

3. The kit as recited in claim 2, wherein the durable UV resistant plastic material is transparent Polypropylene (PP) material.

4. The kit as recited in claim 2, wherein the durable UV resistant plastic material is available in a variety of colors to match with the interior of the swimming pool.

5. The kit as recited in claim 1, wherein the resting portions flatly engage a top surface of the main drain cover in order to hold the clip-on protective device in a vertical position.

6. The kit as recited in claim 1, wherein the clip-on protective device and the two resting portions have a width of 0.7 inch.

7. The kit as recited in claim 1, wherein each mounting hook has a width smaller than a width of the apertures so each hook can easily snap into the apertures.

8. The kit as recited in claim 1, wherein the installation tool and a shaft of the tool are both made of Polyamide (PA), and Glass fiber Reinforcement.

9. The kit as recited in claim 1, wherein the installation tool further comprises three cylindrical retainers are arranged in a triangular configuration.

10. The kit as recited in claim 9, wherein a distance between apex retainer to each other retainer is about 2.0 inches and a distance between other two retainers is about 3.5 inches.

11. The kit as recited in claim 9, wherein each of the retainers has a height of 0. 85 inch and a radius of 0.15 inch.

12. A kit for preventing a swimming pool cleaner from becoming caught on a main drain cover being on top of a main drain of a swimming pool comprising:

a) a clip-on protective device; and b) an installation tool to mount the clip-on protective device onto two opposite apertures of a circular ring of apertures of the main drain cover at a bottom of a swimming pool to force the swimming pool cleaner to tilt to one side, so that suction forces of the swimming pool cleaner and the main drain will not interact with each other;

wherein the installation tool further comprises a shaft insertable and maintained within an open end of a telescoping pool utility pole and the shaft has a flat extension piece.

13. The kit as recited in claim 1, wherein the installation tool further comprising a plurality of keyways on a back and each of the keyways having an incremental angle equal or not equal to one or more other incremental angles.

14. The kit as recited in claim 12, wherein the flat extension piece further has hexagonal ridges for a wing nut and a key to mate with one of five keyways on a back of the installation tool.

15. The kit as recited in claim 1, wherein the installation tool is made by injection molding.

16. The kit of claim 12, wherein the installation tool further comprises:

a threaded shank mounted transversely to the flat extension piece;

a head having a hole at an apex thereof for the threaded shank to extend therethrough;

a nut to engage with the threaded shank to pivotally retain the triangular shaped head to the flat extension piece; and three spaced apart cylindrical retainers on head to releasably hold the clip-on protective device thereto, one of the retainers being located away from a line connecting the other two retainers.

17. The kit as recited in claim 1, wherein the circular ring of apertures further comprises fifty apertures each has a width of 0.3 inch.

18. A method for using a protective clip-on device to prevent a swimming pool cleaner from becoming caught on a main drain cover of a swimming pool comprising the steps of:

a) attaching an installation tool to a telescoping pool utility pole;

b) placing a clip-on protective device onto the installation tool wherein the clip-on protective device is held by three cylindrical retainers in a triangular configuration;

c) maneuvering the installation tool with the clip-on protective device in an upstanding position over the main drain cover from one side of the swimming pool;

d) inserting a first hook of the clip-on protective device into a first aperture on an outer circumference of the main drain cover;

e) stretching the clip-on protective device across the main drain cover;

f) snapping a second hook of the clip-on protective device into a second aperture on the outer circumference of the main drain cover so the clip-on protective device can be held firmly in the upstanding position; and g) removing horizontally the installation tool from the clip-on protective device, whereby the clip-on protective device will prevent the swimming pool cleaner from becoming caught on the main drain cover of the swimming pool.

* * * * *